United States Patent [19]

Beldham

[11] Patent Number: 4,981,024

[45] Date of Patent: Jan. 1, 1991

[54] APPARATUS, SYSTEM, AND METHOD FOR DISPENSING LAUNDRY CHEMICALS

[75] Inventor: Paul M. Beldham, El Toro, Calif.

[73] Assignee: Belco Equipment, Inc., El Toro, Calif.

[21] Appl. No.: 306,827

[22] Filed: Feb. 3, 1989

[51] Int. Cl.[5] ..... D06F 33/02; D06F 39/02

[52] U.S. Cl. ..... 68/12 R; 68/17 R; 68/207; 194/243; 222/2

[58] Field of Search ..... 68/17 R, 207, 12 R; 134/93, 100; 222/2; 194/243

[56] References Cited

U.S. PATENT DOCUMENTS

| | | | |
|---|---|---|---|
| 2,137,928 | 11/1938 | Tanqueray . | |
| 2,144,172 | 1/1939 | Welcome | 194/243 X |
| 3,012,428 | 12/1961 | Cissell | 194/243 X |
| 3,021,702 | 2/1962 | Houser | 68/207 |
| 3,038,639 | 6/1962 | Anderson . | |
| 3,149,754 | 9/1964 | Kogan et al. . | |
| 3,307,744 | 3/1967 | Burford . | |
| 3,771,333 | 11/1973 | Jurjans | 68/17 R X |
| 3,804,297 | 4/1974 | Jurjans | 68/17 R X |
| 3,826,113 | 7/1974 | Noraas et al. | 68/17 R X |
| 3,982,666 | 9/1976 | Kleimola et al. | 68/17 R X |
| 4,103,520 | 8/1978 | Jarvis et al. | 68/17 R X |
| 4,188,807 | 2/1980 | Graf et al. | 68/17 R |
| 4,248,266 | 2/1981 | Queen | 137/564.5 |
| 4,503,575 | 3/1985 | Knoop et al. | 68/17 R X |

*Primary Examiner*—Philip R. Coe

*Attorney, Agent, or Firm*—Gordon L. Peterson; Loyal M. Hanson

[57] ABSTRACT

A system for injecting a laundry chemical into a washing machine includes means for injecting a chemical into a washing machine and coin-operated means for actuating it. One embodiment includes interconnected first, second, and third components configured for use with a source of a laundry chemical, a source of water, and a washing machine of the type having a washing machine cycle, a start switch for starting the washing machine cycle, and a known water flow pattern that occurs after the washing machine cycle has started. The first component produces a first signal indicative of the washing machine cycle having started, the second component produces a second signal indicative of a flow of water from the separate water source into the washing machine, and the third component responds to the first and second signals to identify an occurrence of the known water flow pattern after the washing machine cycle has started and control the injection of a chemical into the washing machine accordingly. Another embodiment inserts in the hot and cold water supply lines, connects to a modified coin slot, and includes microprocessor circuitry that operates to inject during either a wash or a rinse portion of the washing machine cycle.

15 Claims, 4 Drawing Sheets

APPARATUS, SYSTEM, AND METHOD FOR DISPENSING LAUNDRY CHEMICALS

BACKGROUND OF THE INVENTION

1. Technical Field

This invention relates generally to laundry equipment, and more particularly to a new and improved apparatus, system, and method for dispensing the detergents, bleach, fabric conditions, and other such laundry chemicals normally used in an automatic washing machine.

2. Background Information

We often dispense laundry chemicals into the washing machine by carrying them to the washing machine, opening the washing machine lid, and pouring in measured amounts. We add detergent and bleach at the very beginning of a wash cycle in this way and then stand by to add the fabric conditioner during a rinse cycle. But this procedure takes time and attention. It may involve separate coin-operated vending machines for the laundry chemicals, be somewhat frustrating and awkward, result in poorly measured quantities, and even involve spillage and potential liability for resulting damage.

Various automatic dispensing arrangements have been devised to alleviate these concerns, but they may include certain other drawbacks that need to be overcome. For example, U.S. Pat. No. 3,982,666 to Kleimola et al. describes an electrical control apparatus that independently actuates control valves for sequentially and automatically injecting various liquid products into a washing machine. This is accomplished with a trigger signal generating circuit.

The trigger signal generating circuit is synchronized with the washing machine cycle. It selectively actuates and deactuates solenoid-operated valves to allow injection at the desired point in the machine cycle. But this can involve relatively complicated componentry that cannot accommodate cycle interruptions such as may be caused by lifting the washing machine lid during the washing machine cycle.

U.S. Pat. No. 4,103,520 to Jarvis et al. describes another existing system that includes an adaptor for controlling the injection of various liquid chemical additives. The adapter is connected to internal control circuits of the washing machine in order to pick up various signals that can be used for timing purposes. In other words, it is wired into the washing machine.

Thus, the adapter must be configured for the particular washing machine on which it is to be installed. In addition, installation involves internal connections that may invalidate the manufacturer warranties otherwise covering the washing machine. Moreover, in the case of such commercial use as a laundromat, installation may result in the need for Underwriter's Laboratory (UL) approval.

Consequently, it is desirable to have a better way of dispensing or injecting laundry chemicals automatically without the drawbacks mentioned above.

SUMMARY OF THE INVENTION

This invention solves the problems outlined above by providing a coin-operated apparatus, system, and method for dispensing or injecting a laundry chemical into an automatic washing machine. In other words, the user actuates the system with a coin box. Then, the system takes over to inject the laundry chemical at just the right time. Thus, convenient coin operation is provided and installation involves what may be called a non-invasive or non-electrical interface (i.e., connections that can be conveniently accomplished without affecting warranties or requiring renewed UL approval).

Generally, a system constructed according to a broader aspect of the invention includes (1) means for injecting a chemical into a washing machine, and (2) coin-operated means for actuating the injection means by the insertion of a coin. According to various other aspects of the invention, the injection means may include an injection fitting through which to pump the laundry chemical into the water supply line of the washing machine and a pump interconnected in fluid communication with the injection fitting for pumping a laundry chemical obtained from a separate source to the injection fitting.

According to another major aspect of the invention, there is provided a system that operates according to the flow of water into the machine. The system monitors the flow of water into the machine and when the time is right, as indicated by the occurrence of a known water flow pattern after a washing machine cycle has started, a control apparatus initiates the injection of the chemical.

Installation of that system simply involves the connection of a first component, such as a coin box or a sensor on the existing coin slide of a coin-operated machine, for producing a first signal indicative of a washing machine cycle having started and the connection of a second component, such as a flow switch in a water supply line, for producing a second signal indicative of when there exists a flow of water into the washing machine. Furthermore, monitoring the flow of water provides information that can be used to identify interruptions in the washing machine cycle so that the injection timing can be varied accordingly.

Generally, a system constructed to monitor the flow of water includes interconnected first, second, and third components that produce the desired signals and control the injection accordingly. They are configured for use with a source of a laundry chemical, a source of water, and a washing machine of the type having a washing machine cycle, a start switch for starting the washing machine cycle, and a known water flow pattern that occurs after the washing machine cycle has started.

The first component functions as first means for producing a first signal indicative of the washing machine cycle having started. It may include means for detecting the operation of a coin slide or drop or a surge of current, for example. The second component functions as second means for producing a second signal indicative of a flow of water from the separate water source into the washing machine. It may include a known type of flow switch, for example, or other non-invasive device such as a toroidal coil for sensing the flow of current to the washing machine mixing valves or a component for sensing the magnetic field of the valve solenoids, etc. The third component functions as control means responsive to the first and second signals for identifying an occurrence of the known water flow pattern after the washing machine cycle has started and controlling the injection of a chemical into the washing machine accordingly. It may include suitable electronic circuitry.

According to another aspect of the invention, there is provided an injector arrangement responsive to the control means for injecting the chemical into the washing machine, a selector arrangement for enabling a user to select at least one of a plurality of chemicals for injection into the washing machine under control of the control means, and means for initiating injection during one of a wash portion of the washing machine cycle and a rinse portion of the washing machine cycle according to the chemical selected. This is accomplished in one embodiment with a suitably programmed microprocessor.

According to yet another aspect of the invention, there is provided a sensor mounted on the washing machine for sensing actuation of the start switch. This may be done with a washing machine of the type having a coin slide apparatus that operates to actuate the start switch. The sensor is mounted on the coin slide apparatus so that it can sense the presence of a coin in payment for the injection of the laundry chemical when the coin slide apparatus is operated in a manner that actuates the start switch.

According to still another aspect of the invention, there is provided an apparatus for controlling the injection of a laundry chemical into water being supplied to a washing machine of the type having a washing machine cycle, a start switch for starting the washing machine cycle, and a known water flow pattern that occurs after actuation of the start switch. The apparatus includes a first input port through which to receive water from a separate source of water, an output port through which to supply the water to the washing machine, and means for maintaining the input port and output port in fluid communication. The apparatus also includes a second input port through which to receive a quantity of a laundry chemical from a source of the laundry chemical and means for receiving a separately produced first signal indicative of the washing machine cycle having started.

A flow-sensing device produces a second signal indicative of the occurrence of a flow of water from the water input port to the water output port, and control circuitry responsive to the first and second signals identifies an occurrence of the known water flow pattern after the washing machine cycle has started and controls the injection of a chemical into the washing machine accordingly.

In line with the above, a method of controlling the injection of a laundry chemical into a washing machine of the type having a washing machine cycle, a start switch for starting the washing machine cycle, and a known water flow pattern that occurs after the washing machine cycle has started includes the steps of (a) producing a first signal indicative of the washing machine cycle having started, (b) producing a second signal indicative of the occurrence of a flow of water from a separate water source into the washing machine, and (c) utilizing the first and second signals to identifying an occurrence of the known water flow pattern after the washing machine cycle has started in order to control the injection of a chemical into the washing machine accordingly.

The method may proceed by mounting a sensor on the washing machine in a position to sense the actuation of the start switch in order to produce the first signal, and by providing an apparatus configured for connection between a source of water and an input of the washing machine, which apparatus includes a flow-sensing device for producing the second signal.

The combined occurrence of the presence of a coin in a coin slide apparatus as payment for a laundry chemical and the start of a washing machine cycle may be detected according to the invention by mounting a sensor device on the coin slide apparatus in a position to sense the presence of a coin in payment for a laundry chemical when the coin slide apparatus is operated in a manner that actuates the start switch.

In that regard, a coin slide apparatus is disclosed that includes (a) a housing, (b) a slide having at least one slot in which to receive a coin, the slide being mounted on the housing so that it can be moved between a first position in which a user can insert the coin in the slot and a second position in which the slide actuates the start switch on a washing machine, and (c) a sensor mounted on the housing for producing a signal when the slide is moved to the second position with the coin in the slot. The coin slide apparatus can be made by modifying an existing coin slide apparatus in a way that can be conveniently accomplished without affecting warranties or requiring UL approval.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
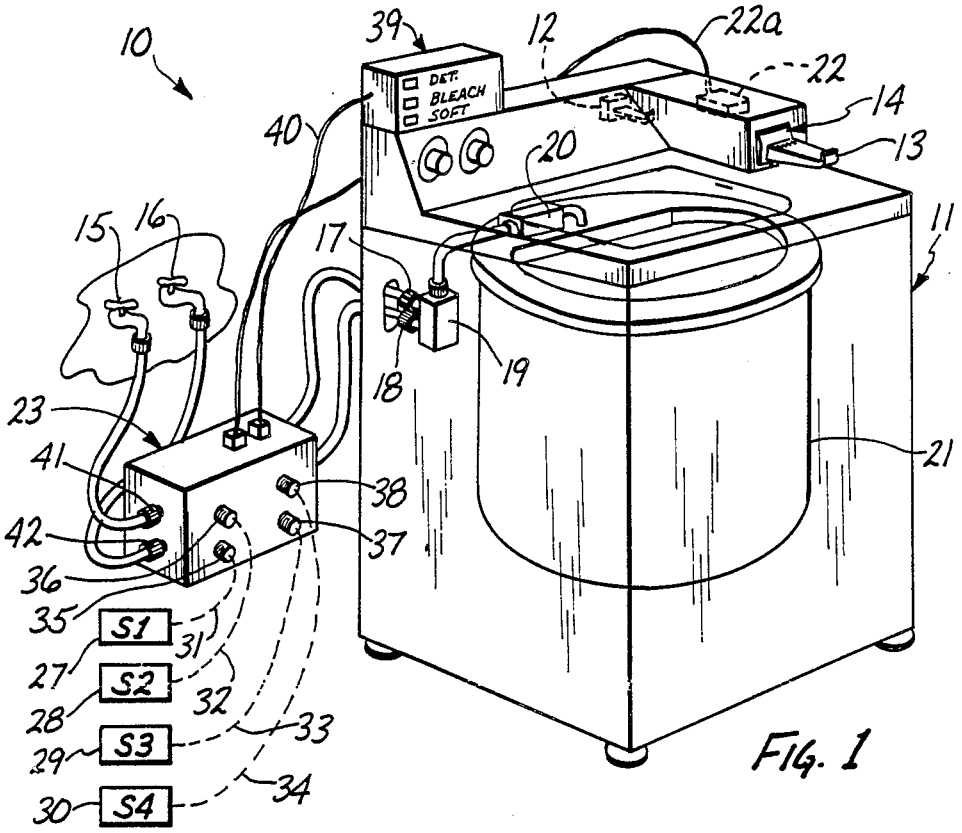
FIG. 1 of the drawings is a perspective view of a system constructed according to the invention shown installed on a conventional laundromat washing machine.

Referring now to FIG. 1, there is shown a system 10 constructed according to the invention. It is installed on a conventional, coin-operated, automatic washing machine 11 of the type commonly employed in many commercial laundromats, and it operates by monitoring the flow of water into the washing machine 11. The washing machine 11 performs a sequence of washing operations (i.e., a washing machine cycle) automatically once the washing machine cycle is started by operation of a coin slide apparatus with the proper number of coins present, and the flow of water pattern provides sufficient information for determining which operation is being performed.

The washing machine 11 includes a start switch 12 for starting the washing machine cycle. The start switch may be arranged for actuation in any of various conventional ways. The start switch can be configured so that a user can actuate it by depressing or pulling a knob, but for the coin-operated washing machine 11, the start switch is actuated by operating a coin slide 13 of a conventional coin slide apparatus 14.

Once the start switch 12 is actuated, the washing machine cycle starts and a known water flow pattern occurs. In other words, once the washing machine cycle has started, water flows in a known way from a separate source of water into the washing machine 11 (i.e., the flow of water from the separate source to the washing machine 11 starts and stops in a known pattern). In that regard, the illustrated separate source of water includes a separate hot water source 15 that supplies water into a hot water inlet 17 of the washing machine 11 and a separate cold water source 16 that supplies water into a cold water inlet 18 of the washing machine 11.

A typical water flow pattern for an automatic washing machine varies during the washing machine cycle. For example, the washing machine cycle may include a wash portion and a rinse portion, with just hot water flowing for a known time period immediately after the washing machine cycle has started in order to fill the washing machine 11 for the wash portion, and with just cold water flowing for a known time period after the washing machine cycle has started in order to fill the washing machine 11 for the rinse portion. Of course the water flow pattern may be different for different washing machines, but it provides information that this invention uses for purposes of controlling injection of laundry chemicals.

In addition to the features mentioned above, the washing machine 11 includes a conventional mixer valve 19 connected to a conventional vacuum breaker 20. Hot water flowing into the hot water inlet 17 and cold water flowing into the cold water inlet 18 are mixed conventionally in the mixer valve 19. The combined flow of water passes from the mixer valve 19 and through the vacuum breaker 20 into the tub 21 of the washing machine 11, the vacuum breaker 20 functioning conventionally to prevent a backflow of water from the tub 21 to the water source. These parts are further discussed subsequently in considering alternative ways of constructing a system within the inventive concepts disclosed.

Generally, the system 10 may be broadly described as including interconnected first, second, and third components that are configured for use with a source of a laundry chemical, a source of water, and a washing machine of the type having a washing machine cycle, a start switch for starting the washing machine cycle, and a known water flow pattern that occurs after the washing machine cycle has started.

The first component is a sensor device 22 mounted on the washing machine 11 in a position to detect actuation of the start switch 12, the first component functioning as first means for producing a first signal indicative of the washing machine cycle having started. The sensor 22 may take the form of a commercially available slotted optical sensor and in the illustrated system 10, the sensor device 22 is mounted on the coin slide apparatus 14 for the above-stated purpose so that it can sense the presence of a coin in payment for the injection of the laundry chemical when the coin slide 13 is operated in a manner that actuates the start switch 12.

In other words, as discussed subsequently, the sensor means is mounted so that it can sense the presence of a coin in payment for the injection of the laundry chemical when the coin slide apparatus 14 is operated in a manner that actuates the start switch 12. This information is utilized by the microprocessor circuitry subsequently discussed in order to inject laundry chemicals under program control. Other means of sensing the start of a machine cycle may be employed, however, such as sensing a change in electrical current flowing to the washing machine 11, a change in vibration level, or a change in noise level.

The second component is a flow-sensing arrangement within an apparatus 23. The apparatus 23 is arranged so that it can be inserted between the hot and cold water sources 15 and 16 and the hot and cold water inlets 17 and 18, and the second component functions as second means for producing a second signal indicative of a flow of water from the separate water source into the washing machine. Generally, the second component can be any suitable non-invasive means for producing the second signal, including current sensing arrangements.

Figure 2:
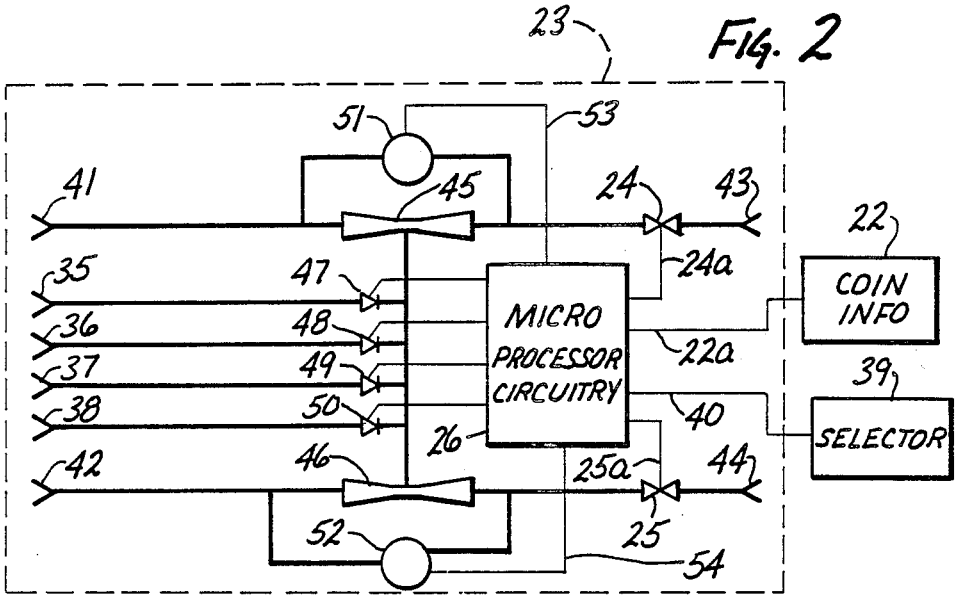
FIG. 2 is a diagrammatic view of the system.

The apparatus 23 may include a box or other housing that can be strapped onto the back of or be otherwise mounted on the washing machine 11, for example, and the flow-sensing arrangement may include flow switches 24 and 25 as illustrated in FIG. 2. In that regard, the flow switches 24 and 25 may be commercially available components such as the 0.25 gallon-per-minute (gpm) flow switches available from Compac Engineering of Paradise, Calif.

The third component is electronic circuitry within the apparatus 23, the third component functioning as control means responsive to the first and second signals for identifying an occurrence of the known water flow pattern after the washing machine cycle has started and controlling the injection of a chemical into the washing machine 11 accordingly.

Microprocessor circuitry 26 is provided in the system 10 for this purpose (FIG. 2). However, it is within the broader inventive concepts disclosed to utilize electronic circuitry that does not include a microprocessor. In other words, the logical functions performed need not necessarily be done under program control within the broader inventive concepts disclosed.

The microprocessor circuitry 26 is suitably arranged and programmed according to known techniques to accomplish the above-mentioned and other desired functions. It may include a line cord or other suitable means for coupling it to a source of electric power (not shown), and the first signal may be communicated to the electronic circuitry by suitable means, such as a line 22*a* in FIG. 1. Of course, the third component (electronic circuitry or microprocessor circuitry 26) may be located apart from the second component (the flow-sensing arrangement or flow switches 24 and 25) within the broader inventive concepts disclosed.

The system 10 operates in conjunction with at least one source of a laundry chemical, such as a source of detergent, laundry soap, stain removing agent, fabric conditioner, neutralizer, iron control agent, or other such chemical. In the system 10, four sources 27–30 of four different laundry chemicals are provided. Each one of the four sources may include a separate drum or other container of a different laundry chemical, such as a first brand of detergent, a second brand of detergent, a bleach, and a fabric softener.

In other words, the first source 27 contains a first brand of detergent to be supplied to the apparatus 23 for injection into the washing machine 11 under control of the microprocessor circuitry 26, the second source 28 contains a second brand of detergent, the third source 29 contains a bleach, and the fourth source 30 contains a fabric conditioner. Of course, other laundry chemicals can be used instead of those mentioned.

Each of the four sources 27–30 is connected in fluid communication with the apparatus 23 by suitable means such as a respective one of flexible conduits 31–34 connected in fluid communication with a respective one of four inlets 35–38 of the apparatus 23. The first, second, and third components are configured for use with the four sources 27–30 in the sense that the four inlets 35–38 are suitably configured to facilitate connection in fluid communication with the four sources 27–30, such as by each one of the four inlets 35–38 including conventional conduit fittings.

The system 10 includes a selector apparatus 39 that functions as selector means for enabling a user to select at least one of a plurality of chemicals for injection into the washing machine under control of the control means. In other words, suitable means such as pushbuttons are provided on the selector apparatus 39 that the user can actuate to select a desired laundry chemical from among the laundry chemicals contained in the four sources 27–30.

The selector apparatus 39 may be mounted on the washing machine by suitable means, behind the washing machine 11 or otherwise. It may include suitable indicators, such as light emitting diodes, for indicating which pushbutton has been actuated, and suitable known circuitry. The selector apparatus 39 is coupled to the microprocessor circuitry 26 in the apparatus 23 by suitable means such as a line 40, with the microprocessor circuitry 26 being suitably arranged and programmed according to known techniques to accomplish the selector function described above.

The system 10 includes injector means responsive to the control means for injecting the chemical into the washing machine 11. In this regard, the apparatus 23 includes hot water input means, such as a hot water input connector 41 (FIGS. 1 and 2), for connecting the apparatus 23 to the hot water source 15. It also includes cold water input means, such as a cold water input connector 42 (FIGS. 1 and 2), for connecting the apparatus 23 to the cold water source 16, hot water output means, such as a hot water output connector 43 (FIG. 2), for connecting the apparatus 23 to the hot water input 17 the washing machine 11, and cold water output means, such as a cold water output connector 44 (FIG. 2), for connecting the apparatus 23 to the cold water input 18 of the washing machine 11.

The hot water input connector 41 and the hot water output connector 43 are connected in fluid communication with each other through a venturi device 45, and the cold water input connector 42 and the cold water output connector 44 are connected in fluid communication with each other through another venturi device 46 (FIG. 2). The venturi devices 45 and 46 combine with four normally closed valves 47–50 to serve as the injector means.

Each of the venturi devices 45 and 46 employs known venturi structure (such as the commercially available model 287 venturi for injecting into a 0.5 gpm flow of water that is sold by Mazzeie) to serves as venturi means for injecting the chemical into water flowing through the apparatus 23. Each of the valves may be a commercially available, normally closed, solenoid actuated valve.

Control signals produced by the microprocessor circuitry 26 are coupled to the valves 47–50 to open selected ones of the valves 47–50 when desired in order to thereby inject a desired laundry chemical into the venturi devices 45 and 46. If only hot water is flowing, injection is via the venturi device 45. If only the cold water is flowing, injection is via the venturi device 46. If both the hot water and the cold water are flowing, injection is via both the venturi devices 45 and 46.

The microprocessor circuitry 26 is suitable arranged and programmed according to known techniques to produce the control signals. This is done so that a selected one of the valves 47–50 is opened to inject the laundry chemical selected with the selector apparatus 39 at an appropriate time during the washing machine cycle for the laundry chemical selected. For example, consider a conventional washing machine cycle having a wash portion and a rinse portion. The selected one of the two brands of detergent (and the bleach, if selected) may be injected during the wash portion of the washing machine cycle while the fabric conditioner should be injected during the rinse portion.

The microprocessor circuitry 26 is suitably programmed according to known techniques to do this at the right time after the washing machine cycle has started (as indicated by the first signal) by monitoring the flow of water into the washing machine 11 (as indicated by the second signal) and looking for a know water flow pattern (through suitable programming). Thus, the microprocessor circuitry 26 serves as means for initiating injection during one of a wash portion of the washing machine cycle and a rinse portion of the washing machine cycle according to the chemical selected.

Alternately, the apparatus 23 may employ four pumps in place of the valves 47–50. Each one of the pumps then serves as means for pumping a respective one of the laundry chemicals into one or both of the venturi devices 45 and 46.

The microprocessor circuitry 26 also produces control signals that are coupled to respective ones of two normally open bypass valves 51 and 52 over respective ones of lines 53 and 54. When open, each one of the bypass valves 51 and 52 permits a full flow of water into the washing machine 11 (i.e., it bypasses a respective one of the venturi devices 45 and 46). Closing the valve 51 at the appropriate time under program control causes hot water from the hot water source 15 to flow through the venturi device 45 for purposes of injecting the laundry chemical into the flow of hot water. Similarly, closing the valve 52 at the appropriate time causes the cold water from the cold water source 16 to flow through the venturi device 46 for purposes of injecting the laundry chemical into the flow of cold water.

In using the system 10, a user operates the selector apparatus 39 (FIGS. 1 and 2) to select the desired laundry chemical. This information is communicated to the microprocessor circuitry 26 over the line 40. Next, the user inserts any coins that may be necessary to start the washing machine 11 and any coins required for the desired laundry chemical into the coin slide 13. Then he operates the coin slide apparatus 14 to start the washing machine cycle, with the sensor 22 communicating the first signal to the microprocessor over the line 22*a*.

Once this is done, the microprocessor circuitry 26 monitors the flow of water into the washing machine 11 by analyzing signals coupled to the microprocessor circuitry from the flow switches 24 and 25 over lines 24a and 25a FIG. 2). And, at just the right time it produces the control signals necessary to close one or both of bypass valves 51 and 52 and open the appropriate one of the valves 47–50 to inject the selected laundry chemical.

Of course, the system 10 can be configured so that the user can select more than one laundry chemical and so that the microprocessor circuitry 26 causes each to be injected at just the right time during the washing machine cycle. Significantly, this is done with a system that senses or monitors the flow of water into the washing machine. Thus, no or little modification of the washing machine is required.

Figure 3:
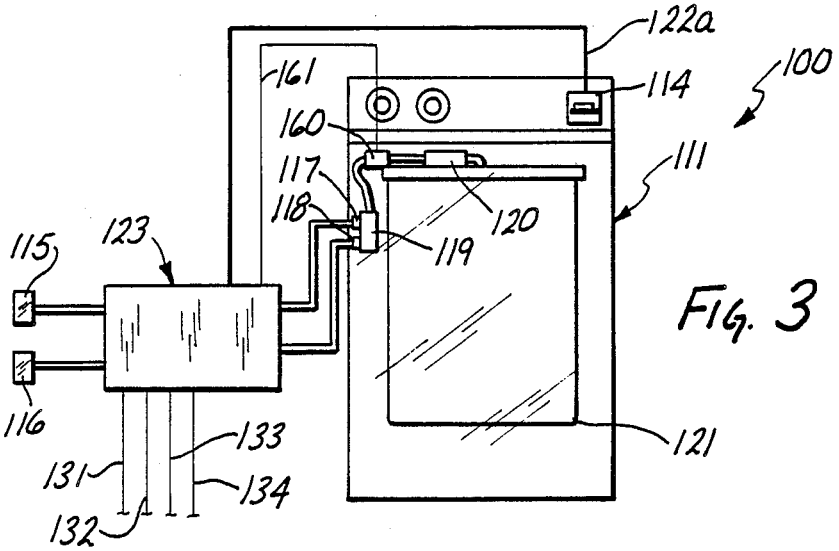
FIG. 3 is a diagrammatic view of a second embodiment that monitors the flow of water with a sensing device provided in the washing machine.

Another way of doing this is illustrated in FIG. 3 which shows a second system or system 100 constructed according to the invention. The system 100 is similar in many respects to the system 10. For convenience, many reference numerals designating parts of the system 100 are increased by one hundred over those designating similar parts of the system 10.

The system 100 includes an apparatus 123 that can be inserted in the hot water and cold water supply lines, between the hot and cold water sources 115 and 116 and the hot and cold water inlets 117 and 118 of a washing machine 111. The washing machine cycle is started by operating a coin slide apparatus 114 on which has been mounted a sensor that is similar to the sensor 22 of the system 10 (not shown) and a line 122a is provided for coupling a first signal to the apparatus 123. Water flows from the apparatus 123 through a mixer valve 119 and a vacuum breaker 120 to the tub 121 of the washing machine 111, and laundry chemicals from separate sources (not shown) are communicated by conduits 131–134.

Unlike the system 10, the system 100 employs a flow sensing device 160 inserted between the mixer valve 119 and the vacuum breaker 120. The flow sensing device 160 is coupled to the apparatus 123 over a line 161 and it serves as second means for producing a second signal indicative of a flow of water from the separate water source into the washing machine. Thus, it serves the function performed by the flow switches 24 and 25 in the system 10, but it does so with one component that can either be retrofitted to an existing machine by inserting it in the water line (no modification of the electrical connections in the washing machine 111) or by including it when the washing machine is originally manufactured. Thus, the system 100 operates in essentially the same manner as the system 10 except for the precise manner in which the flow of water is monitored.

Figure 4:
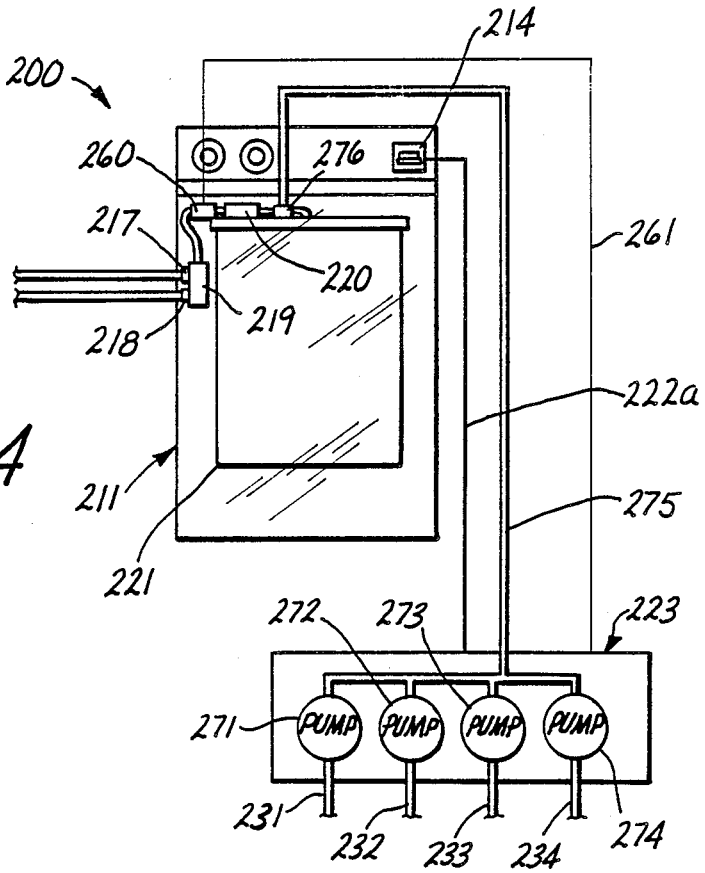
FIG. 4 is a diagrammatic view of a third embodiment that pumps laundry chemicals into the machine.

Yet another system constructed according to the invention, a system 200, is shown in FIG. 4. It is generally similar to the system 10 and the flow sensing arrangement is similar to that used in the system 100. For convenience, many reference numerals designating parts of the system 100 are increased by one hundred over those designating similar parts of the system 100.

Thus, the system 200 includes an apparatus 223 that controls injection of laundry chemicals into a washing machine 211. The washing machine cycle is started by operating a coin slide apparatus 214 on which has been mounted a sensor that is similar to the sensor 22 of the system 10 (not shown) and a line 222a is provided for coupling a first signal to the apparatus 223. Water flows from directly from hot water and cold water sources (not shown) into hot and cold water inlets 217 and 218, and from there through a mixer valve 119, through a flow sensing device 260 that is coupled to the apparatus 223 over a line 261, and through a vacuum breaker 220 to the tub 221 of the washing machine 211. Laundry chemicals from separate sources (not shown) are communicated by conduits 231–234.

Unlike both the system 10 and the system 100, the system 200 does not insert in the hot and cold water supply lines Instead, it includes pumps 271–274 that are actuated under program control by circuitry in the apparatus 223 (not shown) that is generally similar to the microprocessor circuitry 26 of the apparatus 10. The pumps 271–274 are actuated under program control to pump a selected laundry chemical through a conduit 275 into the washing machine 211. This can be done by suitable means, such as by connecting the line 275 to a suitable fitting 276 that is inserted in a line through which the hot and cold water flows as it flows into the tub 221, or by using a conduit installed so that it empties directly into the tub 221. In either case, control is based on an analysis of the flow of water into the washing machine 211.

Figure 5:
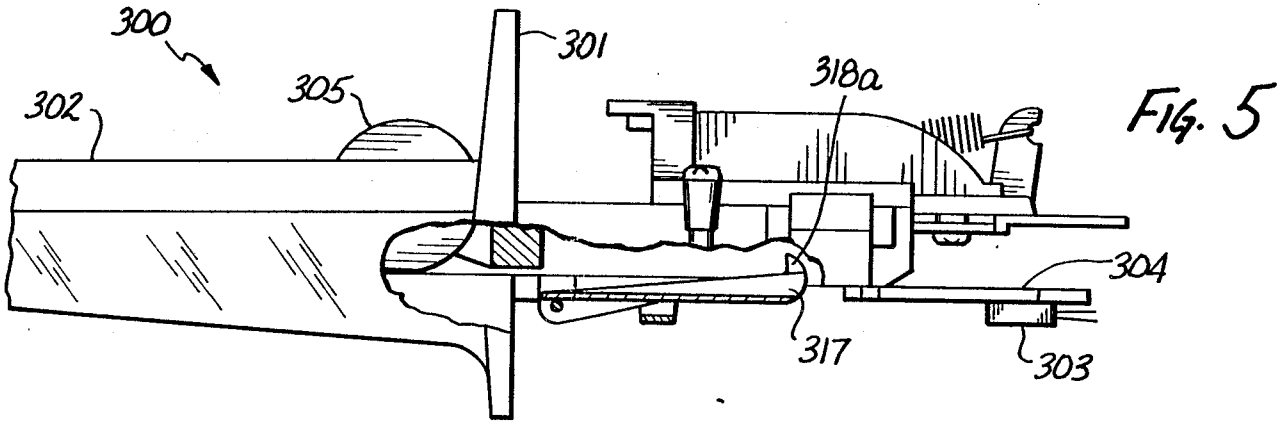
FIG. 5 is a fragmentary elevation view of a portion of a coin slide apparatus constructed according to the invention.
Figure 6:
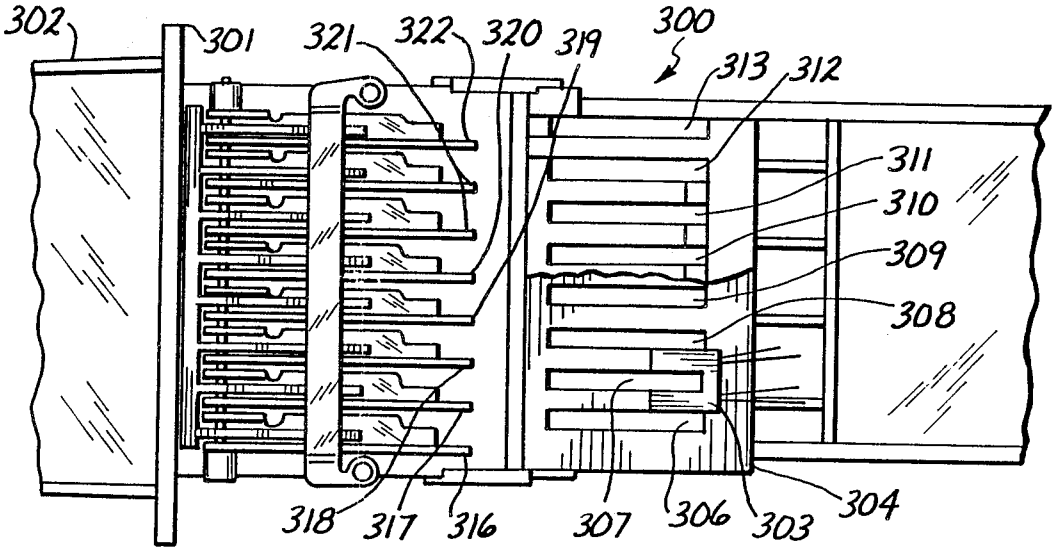
FIG. 6 is an enlarged, fragmentary bottom view of the coin slide apparatus.

Considering now FIGS. 5 and 6, there is shown a coin slide apparatus 300 constructed according to another aspect of the invention for use in the systems 10, 100, and 200, like the coin slide apparatuses 14, 114, and 214. Generally, the apparatus 300 includes a frame 301 and a coin slide 302. It operates conventionally by inserting an appropriate number of coins and pushing the coin slide 302 in.

A sensor 303 is included. It is mounted on a plate 304 and the plate 304 is mounted on the frame 301. This is done so that the sensor 303 is in a position to sense the presence of a coin 305 (FIG. 5) in a predetermined one of a plurality of slots 306–313 (FIG. 6) when the coin slide 302 is pushed in sufficiently to actuate the start switch of the washing machine on which the coin slide apparatus 300 is mounted.

In other words, certain ones of the slots 306–313 are conventionally designated for the coins necessary to start the washing machine cycle. Three of the coin slots 306–313 (slots 308–310, for example) might be so designated for a coin-operated machine requiring that three quarters or seventy-five cents be inserted to start the washing machine cycle. According to this invention, another one of the coin slots 306–313 (slot 307, for example) is the predetermined or designated slot in which the coin 305 must be inserted in payment for the selected laundry chemical.

When the coin slide 302 is pushed in, the coin 305 drops through the slot 307 and the sensor 303 detects this movement to produce the first signal. The sensor 303 may be any of various known devices for this purpose, such as an H2Al slotted optical sensor of the type available from Motorola or Isocom. It is mounted on the plate 304 by suitable means, such as bonding, and the plate 304 is mounted on the frame 301 by suitable means such as screws.

The coin slide apparatus 300 includes a plurality of elongated members or fingers 316–322 that are spring biased upwardly. In that position they function conventionally to control movement of the coin slide 302 into the frame 301 according to whether the appropriate number of coins are present to start the washing machine cycle, each finger having an upwardly extending portion that functions conventionally for this purpose (such as the portion 318a of the finger 318 in FIG. 5).

However, the corresponding portion of the finger 317 is cut off in the coin slide apparatus 300. This disables the finger 317, which corresponds to the slot 307, so that it is available for use in receiving the coin 305 in payment of the selected laundry chemical.

A conventional coin slide apparatus can be conveniently modified in this way. A sensor 303 and plate 304 are added and the upwardly extending portion is removed of the finger or fingers corresponding to the slot or slots to be used in payment of the selected laundry chemical or chemicals.

Thus, this invention provides an apparatus, system, and method for dispensing or injecting a laundry chemical into an automatic washing machine that does so according to the flow of water into the machine. And installation involves connections that can be conveniently accomplished without affecting warranties or requiring UL approval.

In line with the above, a method of controlling the injection of a laundry chemical into a washing machine of the type having a washing machine cycle, a start switch for starting the washing machine cycle, and a known water flow pattern that occurs after the washing machine cycle has started, includes the steps of (a) producing a first signal indicative of the washing machine cycle having started; (b) producing a second signal indicative of the occurrence of a flow of water from a separate water source into the washing machine; and (c) utilizing the first and second signals to identifying an occurrence of the known water flow pattern after the washing machine cycle has started in order to control the injection of a chemical into the washing machine accordingly.

The method may further include mounting sensor means on the washing machine for sensing the actuation of the start switch in order to produce the first signal and providing an apparatus configured for connection between a source of water and an input of the washing machine, which apparatus includes flow-sensing means for producing the second signal.

In addition, the step of providing an apparatus may include providing control means responsive to the first and second signals for identifying an occurrence of the known water flow pattern after the washing machine cycle has started and controlling the injection of a chemical into the washing machine accordingly and injection means responsive to the control means for selectively injecting the laundry chemical into the water.

In connection with the coin slide apparatus 300, a method of detecting the combined occurrence of the presence of a coin in payment for a laundry chemical and the start of a washing machine cycle for a washing machine of the type having a start switch that starts the washing machine cycle and a coin slide apparatus that actuates the start switch, includes the step of mounting a sensor device on the coin slide apparatus in a position to sense the presence of a coin in payment for a laundry chemical when the coin slide apparatus is operated in a manner that actuates the start switch.

Figure 7:
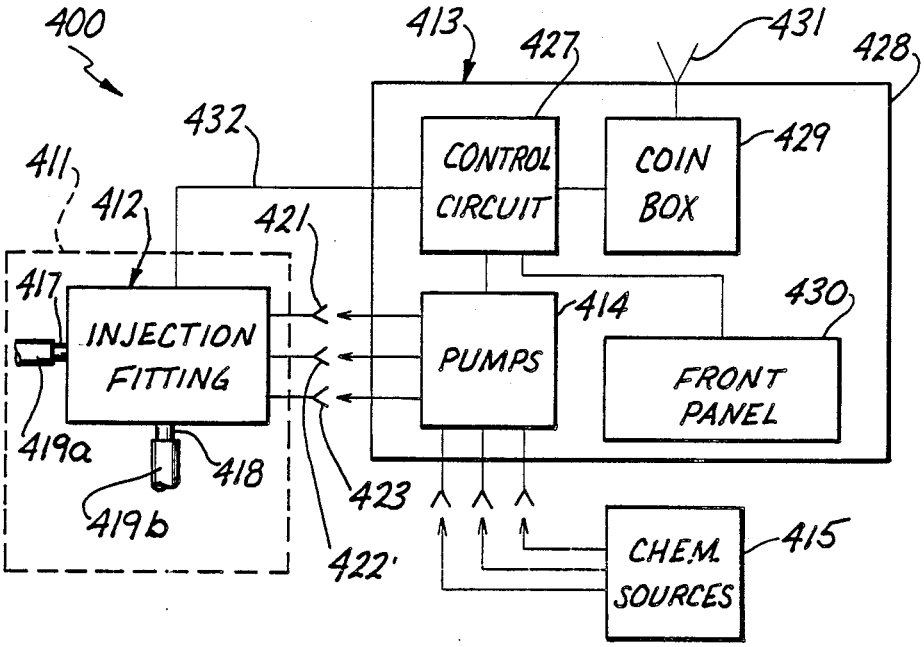
FIG. 7 is a block diagram of another system utilizing a coin drop box and injection fitting.
Figure 8:
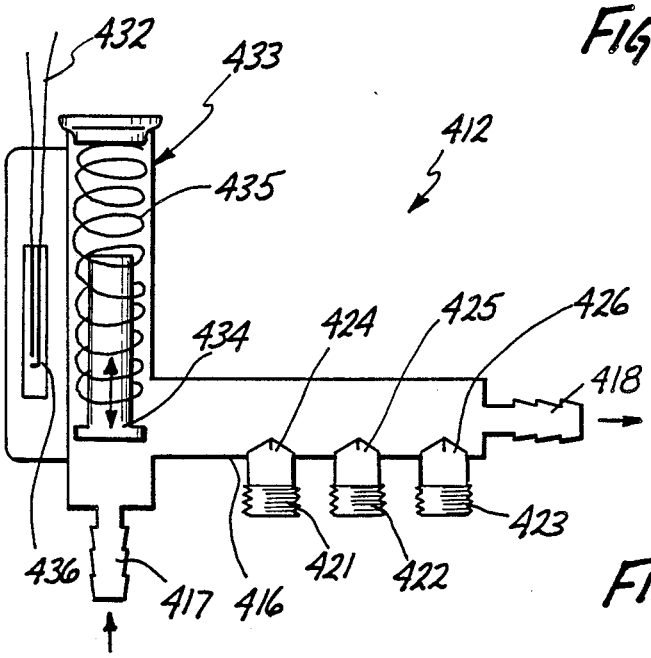
FIG. 8 is an enlarged diagrammatic view of the injection fitting.

Considering now FIGS. 7 and 8, there is shown yet another system which is constructed according to the broader inventive concepts disclosed. It is designated system 400 and shown installed on a conventional washing machine 411. The washing machine 411 is similar to the washing machine 211 illustrated in FIG. 4 except that it need not include the flow sensing device 260 and the fitting 276. Instead it includes an injection fitting 412 (mounted in place of the fitting 276) that combines with an apparatus 413 to provide convenient coin operation and a non-invasive interface as described below.

Generally, the system 400 includes injection means for injecting at least one laundry chemical into a washing machine, control means for controlling the injection means in order to inject the laundry chemical at a desired portion of a washing machine cycle, and coin-operated means for enabling the control means by the insertion of a coin. The injection means includes the injection fitting 412 and a pumping arrangement 414 (FIG. 7) that utilizes known pumping components, such as peristaltic pumps, to pump laundry chemicals from separate sources 415 to the injection fitting 412.

The injection fitting 412 is arranged to be inserted in the water supply line of the washing machine 411 downstream of the vacuum breaker of the washing machine 411 (similar to the vacuum breaker 220 of the washing machine 211 in FIG. 4). Thus, it includes a body 416 (composed of a suitable material such as an injection molded plastic) that has an inlet 417 and an outlet 418 in fluid communication with the inlet 417 (FIGS. 7 and 8). The inlet 417 and the outlet 418 may include suitable known connectors, such as barb connectors, to which first and second sections **419*a* and 419*b* of the water supply line can be coupled Water being supplied to the washing machine 411 flows from the vacuum breaker of the washing machine 411 through the first section 419*a* of the water supply line into the inlet 417, then through the body 416 of the injection fitting 412 to the outlet 418, then out the outlet 418 and through the section 419*b* of the water supply line toward the tub of the washing machine 411**.

An injection fitting for a system constructed according to the invention includes means for receiving the laundry chemical and injecting the laundry chemical into the water supply line. This is accomplished in the illustrated injection fitting 412 with three laundry chemical input ports or connectors 421–423 (FIGS. 7 and 8). The connectors 421–423 are configured to be in fluid communication with the outlet 418 and they employ suitable known means, such as duckbill backcheck valves 424–426 (FIG. 8), to allow the laundry chemicals to be pumped from the pumping arrangement 414 into the injection fitting 412 while preventing a backflow of liquid from the injection fitting 412 back out of the connectors 421–423.

A system constructed according to the invention includes control means for controlling the injection means in order to inject a laundry chemical at a desired portion of a washing machine cycle. This is accomplished in the system 400 with suitable control circuit 427 (that may include known microprocessor circuitry programmed in a known way to achieve the functions described) that is housed in a cabinet 428 along with a coin box arrangement 429 (FIG. 7). The cabinet 428 is suitably dimensioned and arranged so that it can be placed in an accessible position on or adjacent the washing machine 411, and it includes a front panel arrangement 430 for communicating with a user and a coin slot 431 in which the user inserts a coin in order to select a laundry chemical for injection.

The control circuit 427 receives a first signal over a line 432 (FIG. 7) from a flow sensing device that serves as means for producing a first signal indicative of the occurrence of a flow of water in the water supply line of the washing machine. In the system 400, a flow sensing device 433 is built into the injection fitting 412. Thus, the injection fitting 412 includes a magnetic plunger 434 that moves against a spring 435 in a known way when water flows into the inlet 417 to actuate a reed switch 436, actuation of the reed switch 436 resulting in the first signal. Generally, however, the flow sensing device may be any suitable means for producing the first signal; including current sensing arrangements for sensing a change in or the occurrence of the flow of current to the washing machine.

The control circuit 427 also receives a second signal from the coin box arrangement 429 when the correct coins are inserted in the coin slot 431. In that regard, the coin box 429 serves as coin-operated means for enabling the control means by the insertion of a coin and it employs suitable known means to produce the second signal when a predetermine number of one or more types of coins is inserted in the coin slot 431.

The control circuit 427 responds to the first signal from the flow sensing device 433 and the second signal from the coin box arrangement 429 in order to control the pump arrangement 414 In other words, it serves as means responsive to the first and second signals for controlling the pumping means in order to inject the laundry chemical at the desired portion of the washing machine cycle. Known microprocessor circuitry programmed in a known way is utilized in the system 400 for this purpose.

In order to use the system 400, a user operates front panel controls on the front panel 430, such as knobs or pushbuttons, to select one or more laundry chemicals. Then, the user inserts the required coins in the coin slot 431 to enable the apparatus 413, this being communicated to the control circuit 427 by the second signal described above. At this point, one or more front panel lights on the front panel 430 light to indicate what laundry chemicals have been selected and that the apparatus 413 has been enabled. Of course, voice communications can be used instead, the control circuit 427 being suitably programmed according to known techniques and suitable additional hardware being used to accomplish this function.

Once the apparatus 413 has been enabled, the control circuit awaits receiving the first signal from the flow sensing device 433. When this occurs, the control circuit 433 knows that a washing machine cycle has begun, and thereafter it controls the pump arrangement 414 in order to inject the one or more selected laundry chemicals at the right time (during a wash portion of the washing machine cycle for detergents and during a rinse portion for fabric softeners, for example). For this purpose, the programming may keep track of the time that passes after the start of the washing machine cycle and the period of time for which the water flow occurs in order to inject the laundry chemical at the right time.

Thus, the system 400 can be installed conveniently and non-invasively to provide convenient coin operation and injection at just the right time without the user having to be present. Although an exemplary embodiment of the invention has been shown and described, many changes, modifications, and substitutions may be made by one having ordinary skill in the art without necessarily departing from the spirit and scope of the invention.

What is claimed is:

1. A system for injecting a laundry chemical into a washing machine, comprising:

injection means for injecting at least one laundry chemical into a washing machine;

control means for controlling the injection means in order to inject the laundry chemical at a desired portion of a washing machine cycle;

coin-operated means for enabling the control means by the insertion of a coin;

the injection means including a fitting arranged to be inserted in the water supply line of the washing machine, which fitting includes means for receiving the laundry chemical and injecting the laundry chemical into the water supply line, and pumping means for pumping the laundry chemical to the fitting;

the control means including flow sensing means for producing a first signal indicative of the occurrence of a flow of water in the water supply line of the washing machine;

the coin-operated means including a coin box arrangement that produces a second signal when a coin is inserted; and the control means including microprocessor means responsive to the first signal from the flow sensing means and the second signal from the coin box arrangement for controlling the pumping means in order to inject the laundry chemical at the desired portion of the washing machine cycle.

2. A system as recited in claim 1, further comprising:

selector means for enabling a user to select at least one of a plurality of chemicals for injection into the washing machine under control of the control means.

3. A system as recited in claim 2, wherein the control means includes:

means for initiating injection during one of a wash portion of the washing machine cycle and a rinse portion of the washing machine cycle according to the chemical selected.

4. A system as recited in claim 1, wherein:

the fitting is arranged to be mounted in a washing machine having a vacuum breaker so that the fitting is downstream of the vacuum breaker.

5. A system as recited in claim 1, wherein the fitting includes:

a flow sensing device.

6. A system for injecting a laundry chemical into a washing machine wherein a water supply line supplies water from a source of water to the washing machine, said system comprising:

injection means for injecting at least one laundry chemical into the washing machine;

means responsive to the making of a payment for use of the system for providing a payment signal;

sensing means for providing a flow signal in response to flow of water in the water supply line; and control means responsive to the flow signal and the payment signal for causing operation of the injector means to inject said one laundry chemical into the water supply line.

7. A system as defined in claim 6 wherein the control means includes a microprocessor responsive to said signals for causing operation of the injector means to inject said one laundry chemical into the water supply line.

8. A system as defined in claim 7 wherein the injection means includes a fitting in the water supply line for injecting said one laundry chemical into the water supply line.

9. A system as defined in claim 6 wherein the means for providing a payment signal includes a payment device for enabling a user to pay separately for operation of the washing machine and operation of the injection means to inject said one laundry chemical, said payment signal being provided in response to the making of payment for operation of the injection means to inject said laundry chemical.

10. A system as defined in claim 9 wherein the injection means can inject any of a plurality of the laundry chemicals and including selector means actuable by a user for selecting which of said plurality of laundry chemicals will be injected into the washing machine by said injection means.

11. A system as defined in claim 10 wherein the injection means includes a fitting in the water supply line for injecting said one laundry chemical into the water supply line.

12. A system as defined in claim 6 wherein the injection means can inject any of a plurality of the laundry chemicals and including selector means actuable by a user for selecting which of said plurality of laundry chemicals will be injected into the washing machine by said injection means.

13. A system for injecting a laundry chemical into a washing machine comprising:

injection means for injecting at least one laundry chemical into the washing machine;

payment means for enabling a user to pay separately for operation of the washing machine and operation of the injection means to inject said one laundry chemical;

said payment means providing a payment signal in response to the making of payment for and operation of the injection means to inject said one laundry chemical; and control means responsive to said payment signal for causing operation of the injector means to inject said laundry chemical into the washing machine after start up of the washing machine.

14. A system as defined in claim 13 wherein the injection means can inject any of a plurality of the laundry chemicals and including selector means actuable by a user for selecting which of said plurality of laundry chemicals will be injected into the washing machine by said injection means.

15. A system for injecting a laundry chemical into a washing machine, comprising:

injection means for injecting at least one laundry chemical into a washing machine;

control means for controlling the injection means in order to inject the laundry chemical at a desired portion of a washing machine cycle;

the injection means including a fitting arranged to be inserted in the water supply line of the washing machine, which fitting includes means for receiving the laundry chemical and injecting the laundry chemical into the water supply line, and means for delivering the laundry chemical to the fitting;

the control means including flow sensing means for producing a first signal indicative of the occurrence of a flow of water in the water supply line of the washing machine;

a payment device responsive to payment for the laundry chemical for providing a second signal; and the control means including microprocessor means responsive to the first signal from the flow sensing means and the second signal from the payment device for controlling the delivering means in order to inject the laundry chemical at the desired portion of the washing machine cycle.

* * * * *

UNITED STATES PATENT AND TRADEMARK OFFICE

CERTIFICATE OF CORRECTION

PATENT NO. : 4,981,024

DATED : January 1, 1991

INVENTOR(S) : Paul M. Beldham

It is certified that error appears in the above-identified patent and that said Letters Patent is hereby corrected as shown below:

Column 15, line 5 after "said" insert -- one --.

Signed and Sealed this

Twenty-first Day of July, 1992

*Attest:*

DOUGLAS B. COMER

*Attesting Officer*

*Acting Commissioner of Patents and Trademarks*